US009631890B2

(12) United States Patent
Tseng

(10) Patent No.: US 9,631,890 B2
(45) Date of Patent: Apr. 25, 2017

(54) AIR CANISTER FOR AIRSOFT GUN

(71) Applicant: Jui-Fu Tseng, Yilan (TW)

(72) Inventor: Jui-Fu Tseng, Yilan (TW)

( * ) Notice: Subject to any disclaimer, the term of this patent is extended or adjusted under 35 U.S.C. 154(b) by 152 days.

(21) Appl. No.: 14/752,941

(22) Filed: Jun. 28, 2015

(65) Prior Publication Data

US 2015/0300770 A1 Oct. 22, 2015

(51) Int. Cl.
*F41B 11/62* (2013.01)
*F41B 11/724* (2013.01)

(52) U.S. Cl.
CPC ..... *F41B 11/62* (2013.01); *F41B 11/724* (2013.01)

(58) Field of Classification Search
CPC ..... F41B 11/62; F41B 11/724
USPC .. 222/402.1, 3, 325, 402.13, 402.24, 402.25
See application file for complete search history.

(56) References Cited

U.S. PATENT DOCUMENTS 8,127,755 B2 * 3/2012 Maeda ..... F41B 11/724 124/74
2009/0277436 A1 * 11/2009 Wei ..... F41B 11/723 124/74
2015/0007804 A1 * 1/2015 Tippmann, Jr. ..... F41B 11/722 124/73
2015/0059726 A1 * 3/2015 Harvey ..... F41B 11/62 124/73
2015/0226517 A1 * 8/2015 Tseng ..... F41B 11/62 124/56

* cited by examiner

*Primary Examiner* — Donnell Long

(57) ABSTRACT

A canister of propellant releasably mounted in a stock of an airsoft gun includes a head threadedly secured to a first end of a case and including an intermediate annular groove; a plug threadedly fastened in the head and including first, second, and third O-rings; a plunger disposed through the plug into the head and including a first receptacle, a lateral first opening through the first receptacle, a second receptacle, a lateral second opening through the second receptacle, and an annular flange; a cap threadedly secured to plug and including a bottom opening communicating with the case, and a biasing member biased between a bottom and the flange; a passage member threadedly secured to the case; and a check valve threadedly fastened in the passage member.

1 Claim, 6 Drawing Sheets

AIR CANISTER FOR AIRSOFT GUN

BACKGROUND OF THE INVENTION

1. Field of the Invention

The invention relates to airsoft guns and more particularly to a canister of propellant (e.g., compressed gas or air) for an airsoft gun having improved characteristics.

2. Description of Related Art

A conventional gas magazine of a non-lethal gun comprises a bullet chamber, a gas bottle container, a regulation check valve, a regulation chamber, and a control check valve in a magazine. At least one partitioning member is disposed in the regulation chamber which is above the regulation check valve. The partitioning member divides the regulation chamber into a number of chambers. Small holes are on the partitioning member to interlink the chambers.

While the device enjoys its success in the market, continuing improvements in the exploitation of canister of propellant for airsoft gun are constantly sought.

SUMMARY OF THE INVENTION

It is therefore one object of the invention to provide a canister of propellant, comprising a cylindrical case; a hollow head threadedly secured to a first end of the case, the head including an intermediate annular groove on an outer surface; a hollow plug threadedly fastened in the head, the plug including a first O-ring member disposed thereon, a second O-ring member disposed therein, and a third O-ring member disposed thereon; a cylindrical plunger disposed through the plug into a first end of the head, the plunger including a first receptacle open to a first end, a lateral first opening through the first receptacle, a second receptacle open to a second end and blocked from the first receptacle, a lateral second opening through the second receptacle, and an annular flange adjacent to a second end; a hollow cylindrical cap threadedly secured to plug, the cap including a bottom opening communicating with the case, and a biasing member biased between a bottom and the flange to push the flange against the plug; a hollow, cylindrical passage member threadedly secured to a second end of the case; and a check valve threadedly fastened in the passage member, the check valve including an annular recess on an outer surface, an axial passageway, a lateral opening communicating the axial passageway with the annular recess, and a O-ring element disposed in the annular recess to block the lateral opening of the check valve; wherein the O-ring element is configured to unblock the lateral opening of the check valve in response to pressurized gas passing through the lateral opening of the check valve; and wherein in response to pushing the first receptacle, the biasing member is further compressed to move both the first and second openings between the first O-ring member and the second O-ring member, thereby flowing pressurized gas in the case out of the head via the bottom opening of the cap, the second receptacle, the second opening, a gap between the plunger and the plug, the first opening, and the first receptacle.

The above and other objects, features and advantages of the invention will become apparent from the following detailed description taken with the accompanying drawings.

DETAILED DESCRIPTION OF THE INVENTION

Figure 1:
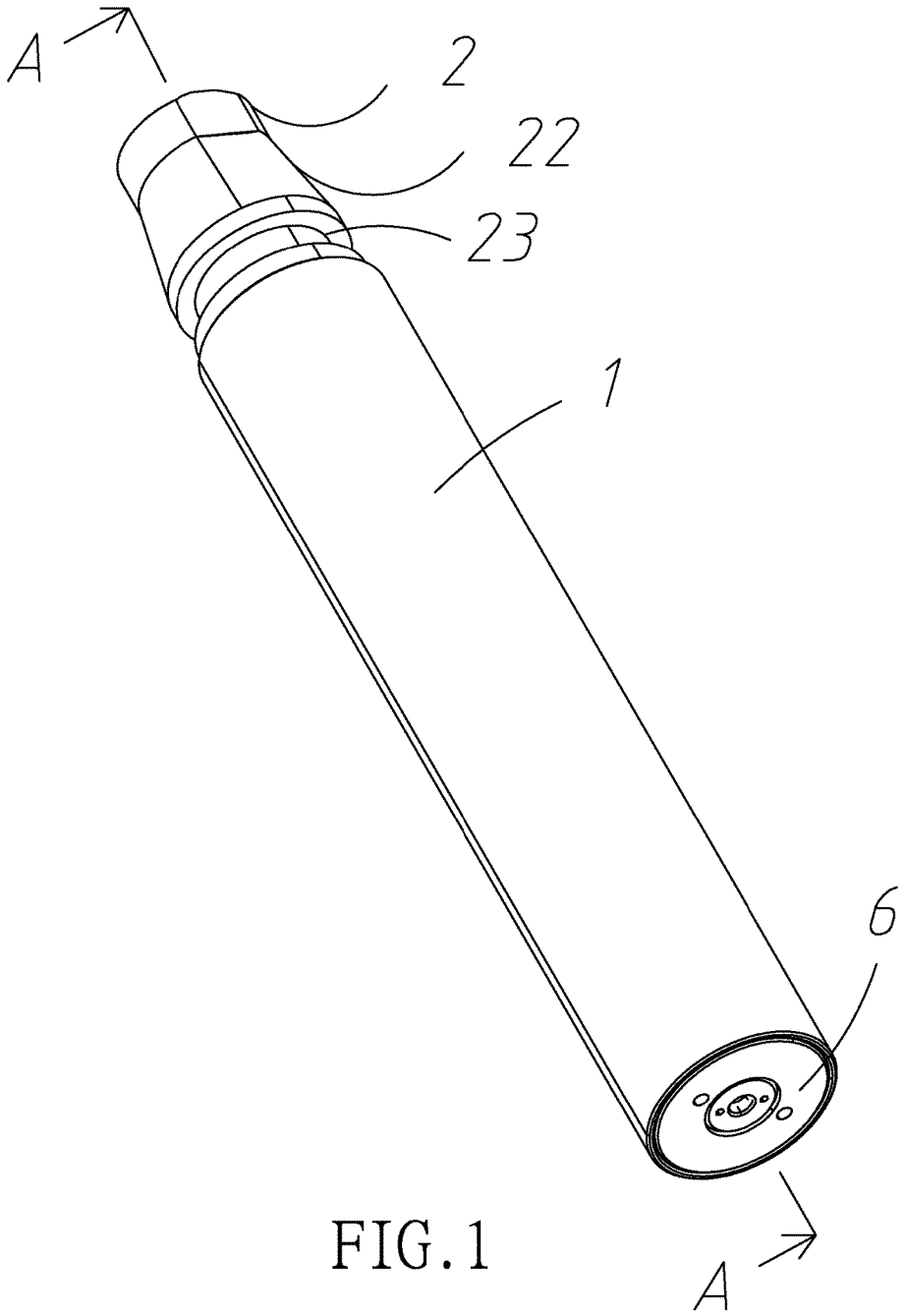
FIG. 1 is a perspective view of a canister of propellant for an airsoft gun according to the invention.
Figure 2:
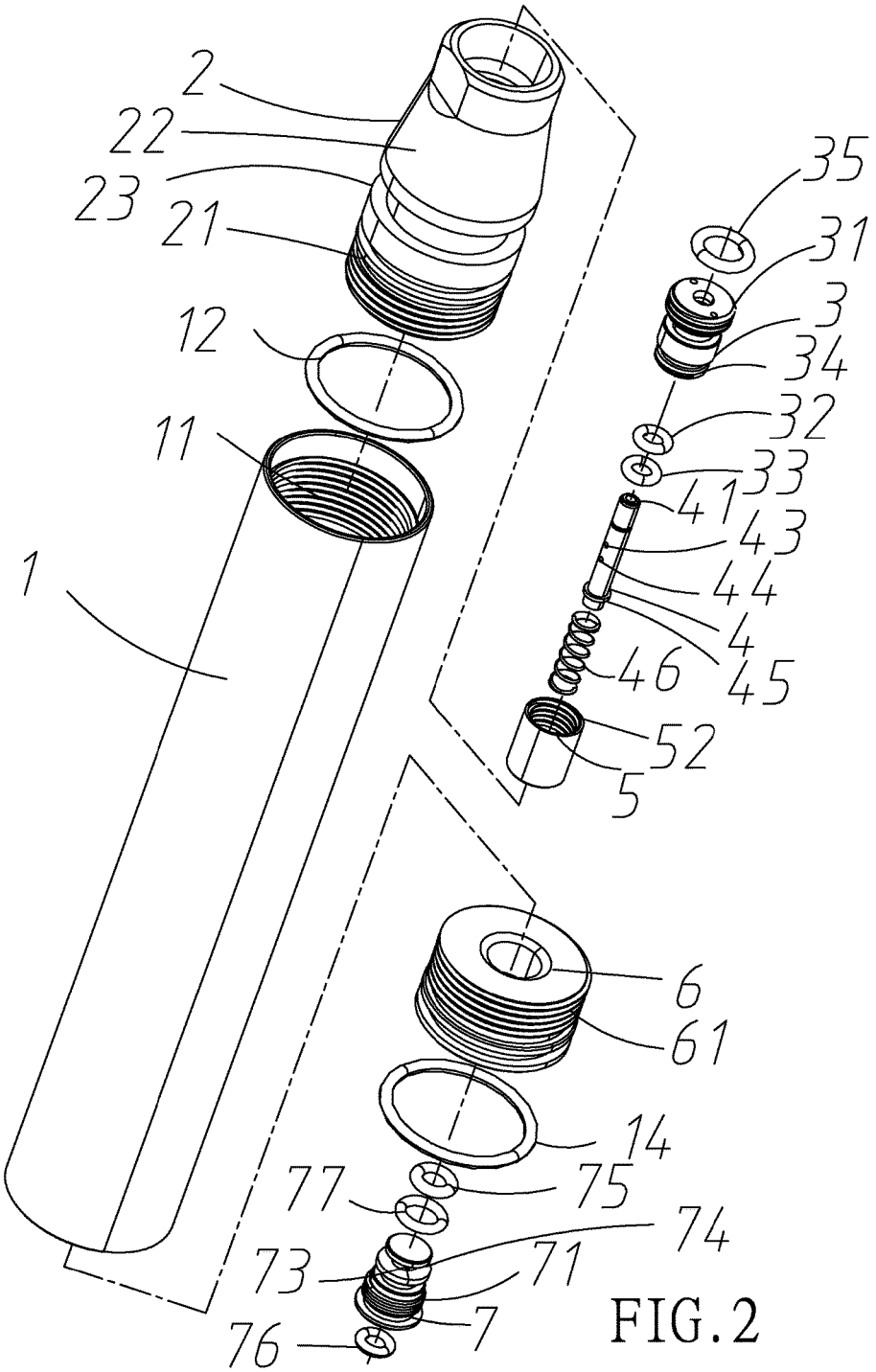
FIG. 2 is an exploded view of the canister.
Figure 3:
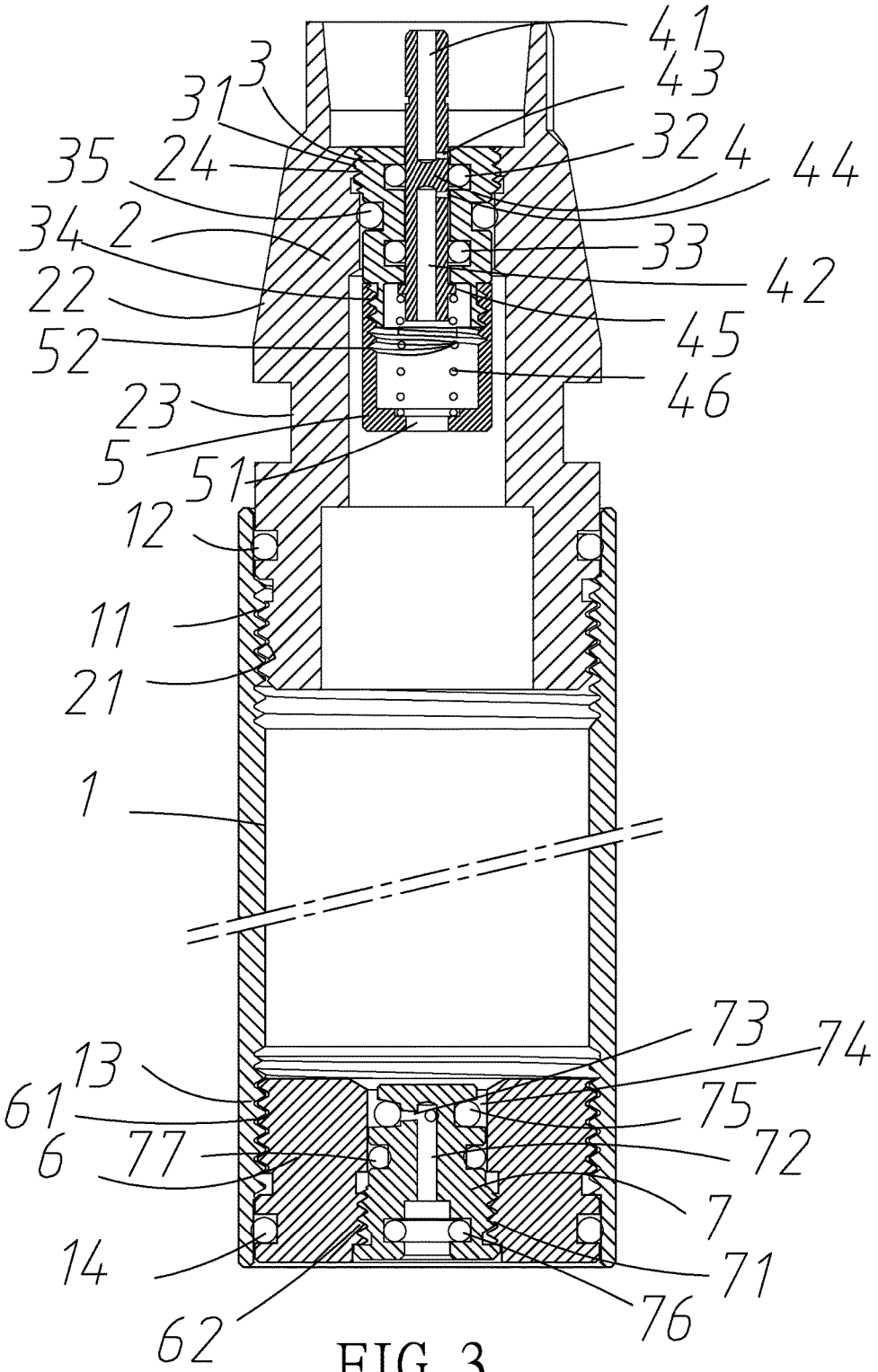
FIG. 3 is a sectional view taken along line A-A of FIG. 1.
Figure 4:
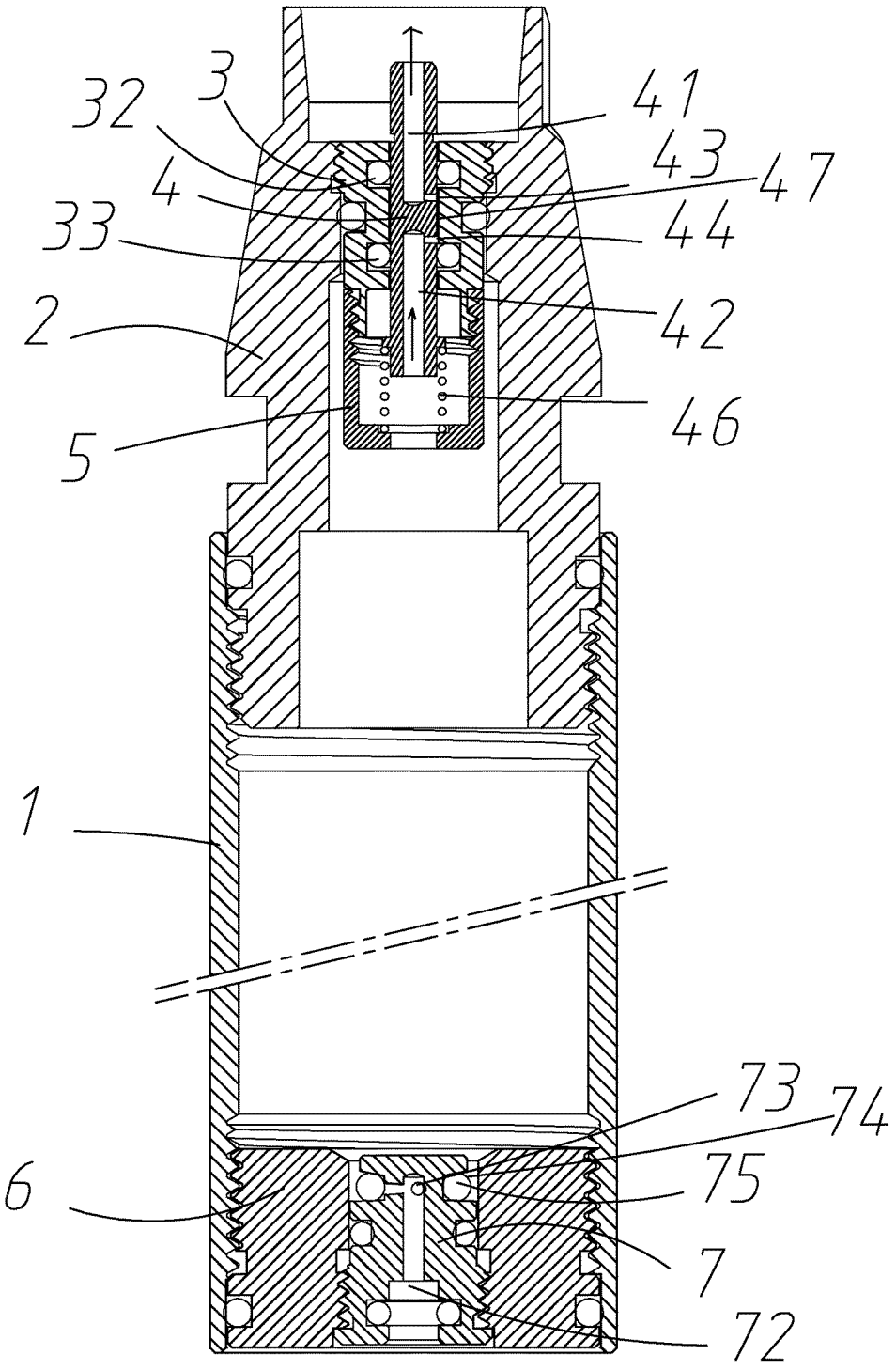
FIG. 4 is a view similar to FIG. 3 showing release of the propellant.
Figure 5:
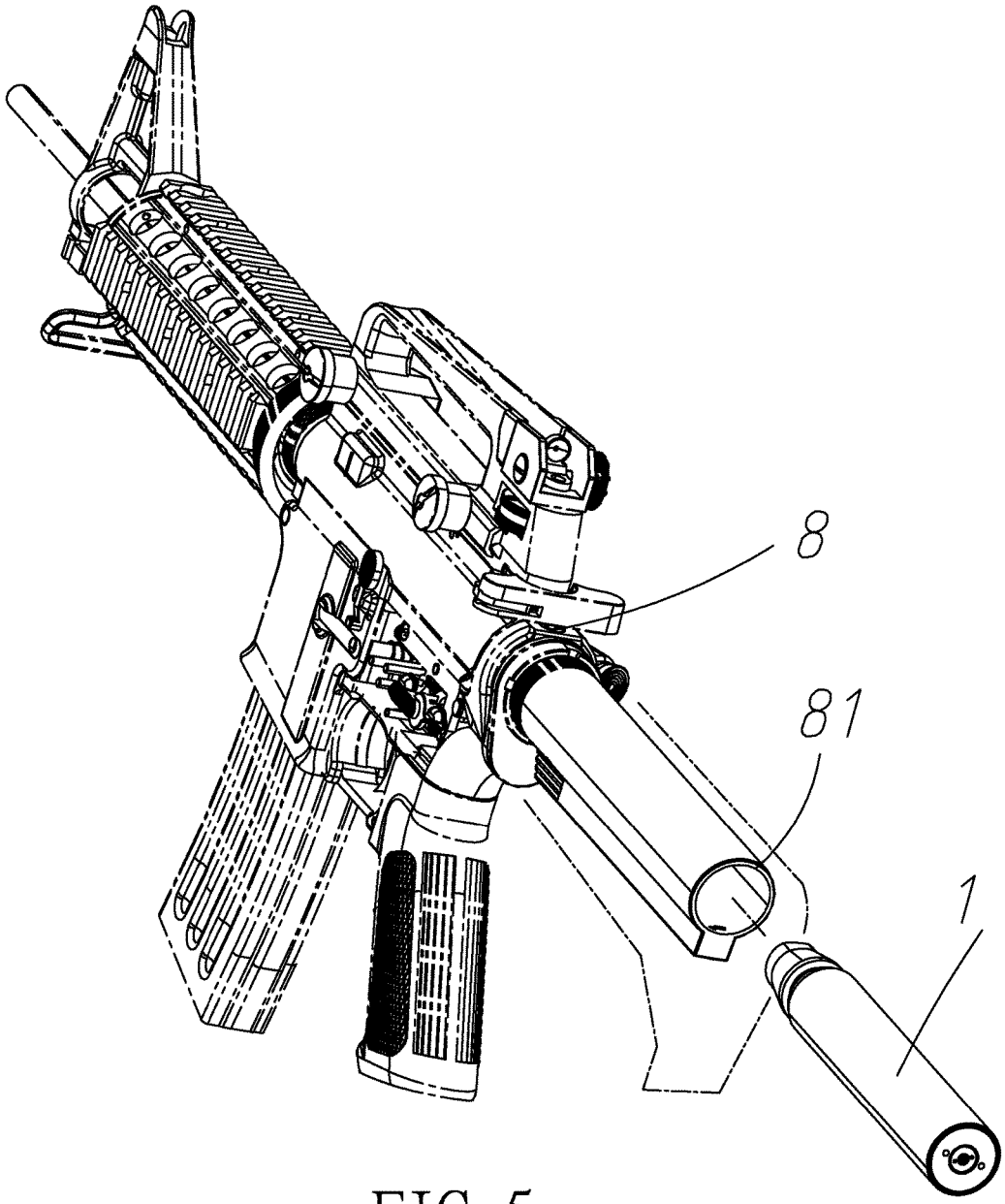
FIG. 5 is a perspective view of an air rifle with the canister to be mounted in the stock.
Figure 6:
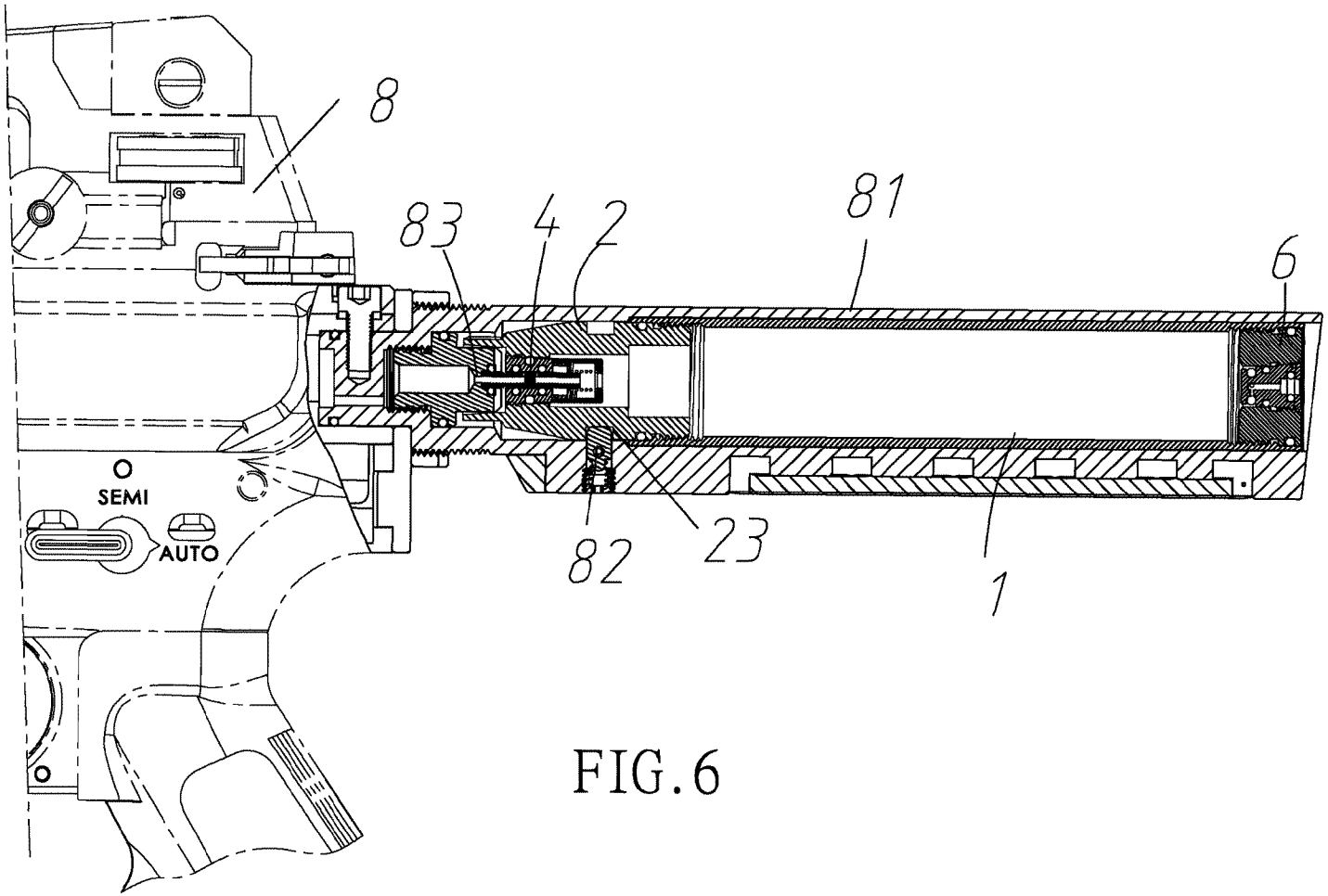
FIG. 6 is a side elevation of the rear portion of the air rifle in part section when the canister is mounted in the stock.

Referring to FIGS. 1 to 6, a canister of propellant (e.g., compressed gas or air) for an airsoft gun (e.g., air rifle 8) in accordance with the invention comprises the following components as discussed in detail below.

A cylindrical case 1 includes first internal threads 11 adjacent to a first end and second internal threads 13 adjacent to a second end. A hollow head 2 has two open ends. The head 2 includes external threads 21 on a lower portion, a conic member 22 on an upper portion, an intermediate annular groove 23, and internal threads 24. A hollow plug 3 has two open ends. The plug 3 includes first external threads 31 on an upper portion, second external threads 34 on a lower portion, and first, second, and third O-ring members 32, 33, and 35 in which the first O-ring member 32 is disposed in an upper annular recess (not numbered), the second O-ring member 33 is disposed in a lower annular recess (not numbered), and the third O-ring member 35 is put on an intermediate annular recess (not numbered). A cylindrical plunger 4 includes a first receptacle 41, a lateral first opening 43 through the first receptacle 41, a second receptacle 42, a lateral second opening 44 through the second receptacle 42, an annular flange 45 adjacent to a bottom end, and a torsion spring 46 put on a portion between the bottom end and the flange 45, the torsion spring 46 having one end biased against the flange 45. A hollow cylindrical cap 5 includes an opening 51 through a bottom, and internal threads 52 on an upper portion.

The plunger 4 is moveably disposed through the plug 3 with the flange 45 stopped by an internal shoulder in a lower portion of the plug 3. The internal threads 52 are secured to the second external threads 34 to urge the other end of the torsion spring 46 against the bottom of the cap 5. The plunger 4, the plug 3, and the cap 5 are secured together. Further, they are inserted into the head 2 with the first external threads 31 secured to the internal threads 24. A first O-ring 12 is put on an annular recess (not numbered) of the head 2 between the groove 23 and the external threads 21. Furthermore, the external threads 21 are secured to the first internal threads 11 to secure the head 2 and the case 1 together (see upper portion of FIG. 3).

A check valve 7 includes external threads 71 on an intermediate portion, an axial passageway 72, a lateral opening 73 communicating an upper end of the passageway 72 with an annular recess 74 on an outer surface of the check valve 7, and first, second, and third O-ring elements 75, 76, and 77 in which the first O-ring element 75 is disposed in the recess 74, the second O-ring element 76 is disposed in a lower annular recess (not numbered), and the third O-ring element 77 is put on an intermediate annular recess (not numbered). A hollow cylindrical passage member 6 includes external threads 61 on an upper portion, the external threads 61 secured to the second internal threads 13, and internal threads 62 on a lower portion, the internal threads 62 secured to the external threads 71 when the passage member 6 is fastened in the check valve 7. Further, an O-ring 14 is put on a lower annular recess (not numbered) of the passage member 6. Length of the check valve 7 and length of the passage member 6 are about the same. As a result, the check valve 7, the passage member 6, and the case 1 are secured together (see lower portion of FIG. 3).

An adapter of, for example, a pressurized air source is inserted into the passageway 72. Next, pressurized air expands the first O-ring element 75 to unblock the opening 73. Thus, pressurized air flows into the case 1 via the opening 73. The first O-ring element 75 immediately contracts to block the opening 73 after stopping the air flow. The pressurized air can maintain its pressure for a prolonged period of time due to mainly the airtight blocking of the opening 73 by the first O-ring element 75.

As shown in FIGS. 3 to 6, in use the case 1 of the canister can be mounted in a stock 81 of an air rifle 8 by partially inserting a projection 82 into the groove 23. Also, the first receptacle 41 is pushed inward by an inlet 83 of the air rifle 8 to further compress the torsion spring 46. And in turn, the first opening 43 and the second opening 44 move to positions between the first O-ring member 32 and the second O-ring member 33 (see FIG. 4). As a result, high pressure air in the case 1 flows to the inlet 83 via the opening 51, the second receptacle 42, the second opening 44, a gap 47 between the plunger 4 and the plug 3, the first opening 43, and the first receptacle 41. Thereafter, a firing operation can be performed.

While the invention has been described in terms of preferred embodiments, those skilled in the art will recognize that the invention can be practiced with modifications within the spirit and scope of the appended claims.

What is claimed is:

1. A canister of propellant, comprising:

a cylindrical case;

a hollow head threadedly secured to a first end of the case, the head including an intermediate annular groove on an outer surface;

a hollow plug threadedly fastened in the head, the plug including a first O-ring member disposed thereon, a second O-ring member disposed therein, and a third O-ring member disposed thereon;

a cylindrical plunger disposed through the plug into a first end of the head, the plunger including a first receptacle open to a first end, a lateral first opening through the first receptacle, a second receptacle open to a second end and blocked from the first receptacle, a lateral second opening through the second receptacle, and an annular flange adjacent to a second end;

a hollow cylindrical cap threadedly secured to plug, the cap including a bottom opening communicating with the case, and a biasing member biased between a bottom and the flange to push the flange against the plug;

a hollow cylindrical passage member threadedly secured to a second end of the case; and a check valve threadedly fastened in the passage member, the check valve including an annular recess on an outer surface, an axial passageway, a lateral opening communicating the axial passageway with the annular recess, and a O-ring element disposed in the annular recess to block the lateral opening of the check valve;

wherein the O-ring element is configured to unblock the lateral opening of the check valve in response to pressurized gas passing through the lateral opening of the check valve; and wherein in response to pushing the first receptacle inward, the biasing member is further compressed to move both the first and second openings between the first O-ring member and the second O-ring member, thereby flowing pressurized gas in the case out of the head via the bottom opening of the cap, the second receptacle, the second opening, a gap between the plunger and the plug, the first opening, and the first receptacle.

* * * * *